US009777248B2

(12) United States Patent
Masters et al.

(10) Patent No.: US 9,777,248 B2
(45) **Date of Patent: *Oct. 3, 2017**

(54) AQUEOUS HARD SURFACE CLEANERS BASED ON MONOUNSATURATED FATTY AMIDES

(71) Applicant: Stepan Company, Northfield, IL (US)

(72) Inventors: Ronald A. Masters, Glenview, IL (US); Wilma Gorman, Park Ridge, IL (US)

(73) Assignee: Stepan Company, Northfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/426,362

(22) PCT Filed: Sep. 5, 2013

(86) PCT No.: PCT/US2013/058316

§ 371 (c)(1),
(2) Date: Mar. 5, 2015

(87) PCT Pub. No.: WO2014/042961

PCT Pub. Date: Mar. 20, 2014

(65) Prior Publication Data

US 2015/0225674 A1 Aug. 13, 2015

Related U.S. Application Data

(60) Provisional application No. 61/700,821, filed on Sep. 13, 2012.

(51) Int. Cl.

| | |
|---|---|
| ***C11D 1/02*** | (2006.01) |
| ***C11D 1/66*** | (2006.01) |
| ***C11D 3/32*** | (2006.01) |
| ***C11D 1/72*** | (2006.01) |
| ***C11D 3/20*** | (2006.01) |
| ***C11D 1/29*** | (2006.01) |
| ***C11D 1/83*** | (2006.01) |
| ***C11D 1/52*** | (2006.01) |
| ***C11D 1/65*** | (2006.01) |
| ***C11D 1/835*** | (2006.01) |
| ***C11D 1/94*** | (2006.01) |

(52) U.S. Cl.

CPC ..... *C11D 3/32* (2013.01); *C11D 1/02* (2013.01); *C11D 1/29* (2013.01); *C11D 1/521* (2013.01); *C11D 1/65* (2013.01); *C11D 1/66* (2013.01); *C11D 1/72* (2013.01); *C11D 1/83* (2013.01); *C11D 1/835* (2013.01); *C11D 1/94* (2013.01); *C11D 3/2082* (2013.01); *C11D 3/2086* (2013.01)

(58) Field of Classification Search

CPC .... C11D 1/02; C11D 1/29; C11D 1/66; C11D 1/72; C11D 1/83; C11D 3/2082; C11D 3/32

USPC ..... 510/235, 238, 245, 254, 264, 421, 422, 510/424, 426, 427, 433, 434, 477, 488, 510/501

See application file for complete search history.

(56) References Cited

U.S. PATENT DOCUMENTS

| | | | | |
|---|---|---|---|---|
| 3,155,591 | A | 11/1964 | Hilfer | |
| 3,929,678 | A | 12/1975 | Laughlin et al. | |
| 3,959,461 | A | 5/1976 | Bailey et al. | |
| 4,275,055 | A | 6/1981 | Nachitgal et al. | |
| 4,285,841 | A | 8/1981 | Barrat et al. | |
| 4,387,090 | A | 6/1983 | Bolich, Jr. | |
| 5,403,515 | A | 4/1995 | Instone et al. | |
| 5,814,590 | A | 9/1998 | Sherry et al. | |
| 5,929,022 | A | 7/1999 | Velazquez | |
| 5,939,059 | A | 8/1999 | Franklin et al. | |
| 5,990,064 | A | 11/1999 | Wierenga et al. | |
| 6,281,178 | B1 | 8/2001 | Ryklin et al. | |
| 6,284,723 | B1 | 9/2001 | Zhou et al. | |
| 6,399,553 | B1 | 6/2002 | Cable et al. | |
| 6,489,285 | B2 | 12/2002 | Faber | |
| 6,511,953 | B1 | 1/2003 | Fontana et al. | |
| 6,528,070 | B1 | 3/2003 | Bratescu et al. | |
| 6,605,584 | B2 | 8/2003 | Fong et al. | |
| 6,949,498 | B2 | 9/2005 | Murphy et al. | |
| 2010/0055198 | A1 | 3/2010 | Wang et al. | |
| 2010/0184855 | A1* | 7/2010 | Bernhardt ..... | A01N 25/30 514/529 |

(Continued)

FOREIGN PATENT DOCUMENTS

| | | | |
|---|---|---|---|
| EP | 2110462 | A1 | 10/2009 |
| EP | 2380954 | A1 | 10/2011 |
| WO | WO2009/127367 | * | 10/2009 |
| WO | 2011/075642 | A1 | 6/2011 |

(Continued)

OTHER PUBLICATIONS

J.C. Mol, Green Chem. 4 (2002) 5.

International Search Report and Written Opinion dated Jan. 28, 2014 from corresponding Application No. PCT/US2013/058316, 9 pages.

*Primary Examiner* — Gregory R Delcotto

(74) *Attorney, Agent, or Firm* — Dilworth IP LLC

(57) ABSTRACT

Aqueous hard surface cleaners and concentrates are disclosed. In one aspect, the cleaners comprise water, a monounsaturated $C_8$-$C_{14}$ fatty N,N-dialkylamide, and at least one anionic, cationic, nonionic, or amphoteric surfactant. The cleaners have a pH within the range of 6.0 to 9.0. Dilutable hard surface cleaner concentrates comprising the monounsaturated N,N-dialkylamide and a surfactant are also disclosed. Also included are aqueous hard surface cleaners which comprise a monounsaturated N,N-dialkylamide, and which by measure of ASTM D4488-95 A5 soil, provide superior percent cleaning at a pH less than 10 than they do at pH 10 and higher. Surprisingly, when a monounsaturated $C_8$-$C_{14}$ fatty N,N-dialkylamide is included in the aqueous hard surface cleaner or concentrate, rapid and thorough cleaning performance can be achieved even at relatively neutral pH. Consequently, the hard surface cleaners are effective on greasy soils, including baked-on soils, despite their low alkalinity.

10 Claims, No Drawings

(56) References Cited

U.S. PATENT DOCUMENTS

| | | | | |
|---|---|---|---|---|
| 2011/0036372 | A1 | 2/2011 | Stirling | |
| 2011/0192421 | A1 | 8/2011 | Bigorra et al. | |
| 2015/0098745 | A1 * | 4/2015 | Brown | C11D 3/188 401/34 |

FOREIGN PATENT DOCUMENTS

| | | | | |
|---|---|---|---|---|
| WO | 2012/061092 | A1 | | 5/2012 |
| WO | 2012/061094 | A1 | | 5/2012 |
| WO | 2012/061103 | A1 | | 5/2012 |
| WO | WO2012/061094 | | * | 5/2012 |
| WO | WO2012/061103 | | * | 5/2012 |
| WO | WO2012/061110 | | * | 5/2012 |
| WO | 2013/162926 | A1 | | 10/2013 |

* cited by examiner

AQUEOUS HARD SURFACE CLEANERS BASED ON MONOUNSATURATED FATTY AMIDES

FIELD OF THE INVENTION

The invention relates to aqueous hard surface cleaners, and in particular, to compositions that provide fast, effective cleaning of greasy soils even at relatively neutral (6-9) pH.

BACKGROUND OF THE INVENTION

Hard surface cleaners continuously evolve and adapt to customer demands, changing times, and increasingly strict health and environmental regulations. Successful hard surface cleaners can remove greasy dirt from smooth or highly polished surfaces and disinfect them without leaving behind noticeable films or streaks. Modern aqueous cleaners typically include one or more surfactants in addition to water. Commonly, the cleaners include a small proportion of low-toxicity organic solvent(s), antimicrobial agents, buffers, sequestering agents, builders, bleaching agents, hydrotropes, perfumes or fragrances, and other components.

Hard surface cleaners designed to clean greasy soils are normally formulated at alkaline pH, typically at or above pH 10, because alkaline pH is known to work better for removing greasy dirt. Formulators would welcome cleaners that work at a more neutral pH in the range of 6 to 9 because such low-alkalinity products will be less hazardous to use and may be better for the environment. For examples of "neutral" hard surface cleaners, see U.S. Pat. No. 5,990,064 (amine oxide surfactant), U.S. Pat. No. 5,403,515 (magnesium alkyl sulfates and a nonionic surfactant), and U.S. Pat. Appl. Publ. No. 2010/0055198 (alcohols and hydrogen peroxide).

Alkalinity is considered especially important when greasy soils are baked on a surface, such as the inside surface of an oven or a grill. Cleaners for such baked-on soils typically include an alkali metal hydroxide as a principal component. Ideally, cleaners could be developed that effectively remove baked-on soils yet are formulated at relatively neutral pH so they are less corrosive and easier to handle safely.

Fatty N,N-dialkylamides have been used in cleaners but typically in industrial applications such as solvent-based degreasers for cleaning metal parts during manufacture. In one recent example (see U.S. Pat. Appl. Publ. No. 2011/0192421), the solvent-based degreaser comprises an alkyl dimethyl amide where the alkyl group has from 2 to 56 carbons.

Foaming light-duty liquid detergents containing fatty N,N-dialkylamides have been described (see PCT Int. Publ. No. WO 2011/075642). The compositions include an anionic surfactant and a foam-stabilizing surfactant (typically an amine oxide) in addition to water and the N,N-dialkylamide. Hard surface cleaners are also disclosed. This is a rare example of the use of fatty N,N-dialkylamides in a mostly aqueous composition. The reference contains no teachings regarding any advantage of using monounsaturated N,N-dialkylamides and is silent regarding any impact of pH on performance.

Fatty N,N-dialkylamides can be made by derivatizing esters or acids generated from hydrolysis or transesterification of triglycerides, which are typically animal or vegetable fats. Consequently, the fatty portion of the acid or ester will typically have 6-22 carbons with a mixture of saturated and internally unsaturated chains. Depending on source, the fatty acid or ester often has a preponderance of $C_{16}$ to $C_{22}$ component. For instance, methanolysis of soybean oil provides the saturated methyl esters of palmitic ($C_{16}$) and stearic ($C_{18}$) acids and the unsaturated methyl esters of oleic ($C_{18}$ monounsaturated), linoleic ($C_{18}$ di-unsaturated), and α-linolenic ($C_{18}$ tri-unsaturated) acids. These materials are generally less than completely satisfactory, however, because compounds having such large carbon chains can behave functionally as soil under some cleaning conditions.

Improvements in metathesis catalysts (see J. C. Mol, *Green Chem.* 4 (2002) 5) provide an opportunity to generate reduced chain length, monounsaturated feedstocks, which are valuable for making detergents and surfactants, from $C_{16}$ to $C_{22}$-rich natural oils such as soybean oil or palm oil. Soybean oil and palm oil can be more economical than, for example, coconut oil, which is a traditional starting material for making detergents. Cross-metathesis of unsaturated fatty esters with olefins generates new olefins and new unsaturated esters that can have reduced chain length and that may be difficult to make otherwise. Despite the availability of unsaturated fatty esters having reduced chain length, fatty N,N-dialkylamides made from these feedstocks are not yet widely available.

Recently, we described new compositions made from feedstocks based on self-metathesis of natural oils or cross-metathesis of natural oils and olefins. Among other compositions, we identified certain monounsaturated fatty amides made by derivatizing the unique feedstocks (see PCT Int. Publ. No. WO 2012/061094). The monounsaturated fatty amides showed outstanding performance as solvents for non-aqueous degreasers. Also exemplified were water-diluted samples containing 5 wt. % of the unsaturated N,N-dialkylamide and 10 wt. % of an amine oxide surfactant. Performance was superior compared with Steposol® M-8-10, a commercially available saturated fatty amide mixture. There is no suggestion to formulate a household hard surface cleaner, which normally has 5 wt. % or less of surfactants, and no mention of formulation pH.

We also recently demonstrated that many derivatives made from metathesis-based feedstocks have value for aqueous hard surface cleaners and industrial degreasers (see PCT Int. Publ. No. WO 2012/061103). In the '103 publication, we observed that the fatty N,N-dialkylamides are excellent as non-aqueous degreasers. In fact, the N,N-dialkylamides outperformed all of the other classes of compositions tested as potential industrial degreasers (see pp. 64-65). Although many classes of compounds were tested in aqueous hard surface cleaners, the N,N-dialkylamides were not evaluated.

Improved aqueous hard surface cleaners are always in demand. A valuable cleaner would perform well to remove greasy dirt, including baked-on soils. Ideally, the cleaner would work at a relatively neutral pH within the range of 6 to 9 to enable the formulation of low-alkalinity household cleaners for improved safety during use.

SUMMARY OF THE INVENTION

In one aspect, the invention relates an aqueous hard surface cleaner. The cleaner comprises from 75 to 99.5 wt. % of water, from 0.1 to 5 wt. % of a monounsaturated $C_8$-$C_{14}$ fatty N,N-dialkylamide, and from 0.1 to 5 wt. % of at least one anionic, cationic, nonionic, or amphoteric surfactant. Unlike most hard surface cleaners, which are formulated for use at strongly alkaline pH, the inventive cleaners have a pH within the range of 6.0 to 9.0.

The invention includes aqueous hard surface cleaners that are suitable for use in removing baked-on soil. These cleaners, which have a pH within the range of 7.0 to 9.0, comprise from 50 to 99 wt. % of water; from 0.5 to 15 wt. % of a monounsaturated $C_8$-$C_{14}$ fatty N,N-dialkylamide; and from 0.5 to 15 wt. % of a surfactant.

In another aspect, the invention relates to dilutable hard surface cleaner concentrates. The concentrates comprise 1 to 50 wt. % of the monounsaturated N,N-dialkylamide and 1 to 50 wt. % of a surfactant. Upon dilution with water, the concentrates give aqueous cleaners having a pH within the range of 6.0 to 9.0.

In yet another aspect, the invention relates to an aqueous hard surface cleaner which comprises a monounsaturated fatty N,N-dialkylamide, and which by measure of ASTM D4488-95 A5 soil, provides superior percent cleaning at a pH less than 10 than it does at pH 10 and higher.

We surprisingly found that when a monounsaturated $C_8$-$C_{14}$ fatty N,N-dialkylamide is included in the aqueous hard surface cleaner or concentrate, rapid and thorough cleaning performance can be achieved even at relatively neutral pH. Consequently, hard surface cleaners that are effective on greasy soils despite having low alkalinity can be formulated.

DETAILED DESCRIPTION OF THE INVENTION

In one aspect, the invention relates to aqueous hard surface cleaners. The cleaners comprise water, a monounsaturated N,N-dialkylamide, and a surfactant.

The hard surface cleaner is water-based. In particular, the cleaner comprises from 75 to 99.5 wt. %, preferably 80 to 99 wt. %, most preferably 85 to 99 wt. % of water.

The hard surface cleaners comprise from 0.1 to 5 wt. %, preferably 0.2 to 4 wt. %, more preferably 0.2 to 3 wt. % of a monounsaturated $C_8$-$C_{14}$ fatty N,N-dialkylamide. Preferred fatty N,N-dialkylamides are $C_8$-$C_{12}$, preferably $C_8$-$C_{10}$ N,N-dialkylamides.

The N,N-dialkylamides are monounsaturated. By "monounsaturated," we mean that most or all of the $C_8$-$C_{14}$ N,N-dialkylamide has a single carbon-carbon double bond.

It may be completely monounsaturated, but it can also be a mixture of saturated and unsaturated materials. Thus, for instance, a mixture containing 75% monounsaturated $C_{10}$ N,N-dialkylamide, 20% saturated $C_{10}$ N,N-dialkylamide, and 5% diiunsaturated $C_{10}$ N,N-dialkylamide would be suitable for use.

Preferably, the monounsaturated N,N-dialkylamide derives from a metathesis-based feedstock, such as an unsaturated alkyl ester or glyceryl ester. In one convenient approach, illustrated by PCT Int. Publ. No. WO 2012/061094, the teachings of which are incorporated herein by reference, the unsaturated alkyl ester or glyceryl ester is generated in a cross-metathesis reaction with an olefin, preferably an α-olefin, and a natural oil, e.g., soybean oil or palm oil. Suitable metathesis catalysts, natural oils, olefins, and reaction conditions are described in the '094 publication. Usually, cross-metathesis of the natural oil is followed by separation of an olefin stream from a modified oil stream, typically by distilling out the more volatile olefins. The modified oil stream is then reacted with a lower alcohol, typically methanol, to give glycerin and a mixture of alkyl esters. This mixture normally includes saturated $C_6$-$C_{22}$ alkyl esters, predominantly $C_{16}$-$C_{18}$ alkyl esters, which are essentially spectators in the metathesis reaction. The terminally unsaturated $C_{10}$ product is accompanied by different coproducts depending upon which α-olefin(s) is used as the cross-metathesis reactant. Thus, 1-butene gives a $C_{12}$ unsaturated alkyl ester, 1-hexene gives a $C_{14}$ unsaturated alkyl ester, and so on. The unsaturated alkyl esters, which are easy to purify by fractional distillation, are excellent starting materials for making many of the monounsaturated fatty N,N-dialkylamides.

The monounsaturated N,N-dialkylamides are preferably made by reacting a monounsaturated fatty acid or ester derivative with a secondary amine according to well-known methods. As the skilled person will appreciate, "ester derivative" here encompasses other acyl equivalents, such as acid chlorides, acid anhydrides, or the like, in addition to the lower alkyl esters and glyceryl esters discussed above. The reactants are typically heated under conditions effective to convert the starting acid or ester derivative to an amide. No catalyst is required, but a basic catalyst such as an alkoxide is optionally included. The reaction temperature is typically within the range of 40° C. to 300° C., preferably from 50° C. to 250° C., and more preferably from 50° C. to 200° C. The reaction mixture is heated until the starting ester, acid, or triglyceride is substantially consumed. The monounsaturated N,N-dialkylamide product can be purified by distillation, water washing, or other normal means if desired.

Suitable secondary amines have one hydrogen attached to the amino group. The remaining groups are typically alkyl or substituted alkyl groups, preferably $C_1$-$C_{10}$ alkyl, more preferably $C_1$-$C_4$ alkyl. Thus, suitable secondary amines include N,N-dimethylamine, N,N-diethylamine, N,N-diisopropylamine, and the like. N,N-dimethylamine is particularly preferred.

Examples of preferred monounsaturated N,N-dialkylamides are illustrated below. Mixtures of the N,N-dialkylamides can be used:

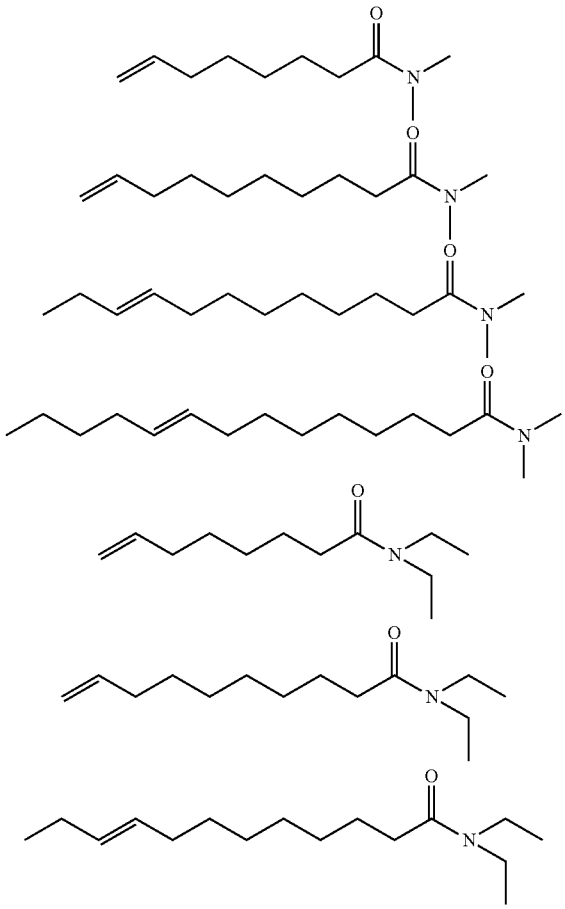

-continued

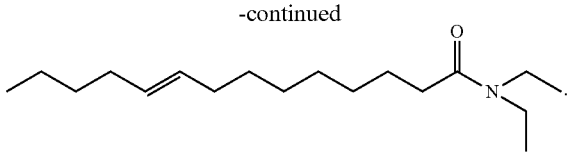

The cleaners further comprise from 0.1 to 5 wt. %, preferably 0.2 to 4 wt. %, more preferably 0.2 to 3 wt. % of one or more surfactants selected from the group consisting of anionic, cationic, nonionic, and amphoteric surfactants.

In contrast to the vast majority of conventional hard surface cleaners, the inventive cleaner has a relatively neutral pH. In particular, the cleaner has (or is adjusted with acid or base to have) a pH within the range of 6.0 to 9.0, preferably 6.2 to 8.8, more preferably 6.5 to 8.5, even more preferably 7.0 to 8.0. Surprisingly, cleaners formulated at pH 6.0 to 9.0 outperform those formulated at a traditional alkaline pH of 11 when a monounsaturated N,N-dialkylamide is present.

Table 1 below shows that the best cleaning performance is observed in examples that include a monounsaturated fatty N,N-dialkylamide and are formulated to about pH 8 (see Examples 1 and 2). Cleaning is not as rapid and overall performance is not as effective with Steposol® M-8-10, a commercially available mixture of saturated C8 and C10 fatty amides when tested at about pH 8 (see Comparative Examples 3 and 4). Under more alkaline conditions (pH ~10), none of the formulations performs as well as the unsaturated fatty amide at pH 8. Even though alkaline conditions are widely considered to be needed to achieve good performance with hard surface cleaners on greasy soils, we surprisingly found that the unsaturated fatty amides perform as well or better at more neutral pH. The result is valuable because neutral formulations are considered to be less corrosive, less toxic, and generally less hazardous to end users.

We also compared the unsaturated C10 fatty N,N-dialkylamide (C10-25) with the Steposol® M-10, its saturated analog, to eliminate possible performance differences attributable to the C8 component of Steposol® M-8-10 (see Table 2). At about pH 8, the unsaturated fatty amide is the clear winner (see Examples 1 and 2 versus Comparative Examples 9 and 10).

We further considered the impact of pH when only the unsaturated fatty amide is present and used dilute acid or base to target a particular pH (see Table 3). The formulations at neutral pH (Examples 14 and 15) perform better than the one at pH 5 (Comparative Example 13) and as well as or better than the formulations at pH 10 (Comparative Examples 16 and 17). The ability to formulate an effective hard surface cleaner for greasy soils at neutral pH is unusual but valuable.

We also evaluated various solvent alternatives to the unsaturated fatty amide in a citrate pH formulation (pH ~8), as shown in Table 4. The monounsaturated fatty amide outperforms common solvents used in hard surface cleaners when tested at the same solvent level at the relatively neutral pH. Moreover, when the concentration of C10-25 is cut in half, the cleaner is still as effective as the traditional favorites.

Surfactants

The inventive aqueous hard surface cleaners comprise one or more surfactants selected from anionic, cationic, nonionic and amphoteric (or zwitterionic) surfactants. The amount of surfactant in the cleaner is 0.1 to 5 wt. %, preferably 0.1 to 4 wt. %, and most preferably 0.2 to 3 wt. %. Combinations of different surfactants can be used. Commonly, an anionic surfactant is paired with a nonionic or amphoteric surfactant. Suitable surfactants are generally known in the art. If desired, one or more of the surfactants can be derived from a metathesis-based feedstock.

Anionic Surfactants

Suitable anionic surfactants are well known in the art. They include, for example, alkyl sulfates, alkyl ether sulfates, olefin sulfonates, α-sulfonated alkyl esters (particularly α-sulfonated methyl esters), α-sulfonated alkyl carboxylates, alkyl aryl sulfonates, sulfoacetates, sulfosuccinates, alkane sulfonates, alkylphenol alkoxylate sulfates, alkyl ether/ethoxy carboxylates, and the like, and mixtures thereof.

In particular, anionic surfactants useful herein include those disclosed in *McCutcheon's Detergents & Emulsifiers* (M.C. Publishing, N. American Ed., 1993); Schwartz et al., *Surface Active Agents, Their Chemistry and Technology* (New York: Interscience, 1949); and in U.S. Pat. Nos. 4,285,841 and 3,919,678, the teachings of which are incorporated herein by reference.

Suitable anionic surfactants include salts (e.g., sodium, potassium, ammonium, and substituted ammonium salts such as mono-, di-, and triethanolamine salts) of anionic sulfate, sulfonate, carboxylate and sarcosinate surfactants. Other suitable anionic surfactants include isethionates (e.g., acyl isethionates), N-acyl taurates, fatty amides of methyl tauride, alkyl succinates, glutamates, sulfoacetates, and sulfosuccinates, monoesters of sulfosuccinate (especially saturated and unsaturated $C_{12}$-$C_{18}$ monoesters), diesters of sulfosuccinate (especially saturated and unsaturated C6-C14 diesters), and N-acyl sarcosinates. Resin acids and hydrogenated resin acids are also suitable, such as rosin, hydrogenated rosin, and resin acids and hydrogenated resin acids present in or derived from tallow oil.

Suitable anionic surfactants include linear and branched primary and secondary alkyl sulfates, alkyl ethoxysulfates, fatty oleyl glycerol sulfates, alkyl phenol ethoxylate sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside. Preferred alkyl sulfates include $C_8$-$C_{22}$, more preferably $C_8$-$C_{16}$, alkyl sulfates. Preferred alkyl ethoxysulfates are $C_8$-$C_{22}$, more preferably $C_8$-$C_{16}$, alkyl sulfates that have been ethoxylated with from 0.5 to 30, more preferably from 1 to 30, moles of ethylene oxide per molecule.

Other suitable anionic surfactants include salts of $C_5$-$C_{20}$ linear alkylbenzene sulfonates, alkyl ester sulfonates, $C_6$-$C_{22}$ primary or secondary alkane sulfonates, $C_6$-$C_{24}$ olefin sulfonates, alkyl glycerol sulfonates, fatty acyl glycerol sulfonates, fatty oleyl glycerol sulfonates, and any mixtures thereof.

Suitable anionic surfactants include $C_8$-$C_{22}$, preferably $C_8$-$C_{18}$, alkyl sulfonates and $C_8$-$C_{22}$, preferably $C_{12}$-$C_{18}$, α-olefin sulfonates. Suitable anionic carboxylate surfactants include alkyl ethoxy carboxylates, alkyl polyethoxy polycarboxylate surfactants and soaps ("alkyl carboxyls"). Preferred sulfosuccinates are $C_8$-$C_{22}$ sulfosuccinates, preferably mono-$C_{10}$-$C_{16}$ alkyl sulfosuccinates such as disodium laureth sulfosuccinate.

Suitable anionic surfactants include sarcosinates of the formula $RCON(R_1)CH_2COOM$, wherein R is a $C_5$-$C_{22}$ linear or branched alkyl or alkenyl group, $R_1$ is $C_1$-$C_4$ alkyl and M is an ion. Preferred sarcosinates include myristyl and oleoyl methyl sarcosinates as sodium salts. Most preferably, the sarcosinate is a $C_{10}$-$C_{16}$ sarcosinate.

Suitable anionic surfactants include alkyl sulfoacetates of the formula $RO(CO)CH_2SO_3M$, wherein R is $C_{12}$-$C_{20}$ alkyl and M is an ion, preferably lauryl and myristyl sulfoacetates as sodium salts.

Many suitable anionic surfactants are commercially available from Stepan Company and are sold under the Alpha-Step®, Bio-Soft®, Bio-Terge®, Cedepal®, Nacconol®, Ninate®, Polystep®, Steol®, Stepanate®, Stepanol®, Stepantan®, and Steposol® trademarks. For further examples of suitable anionic surfactants, see U.S. Pat. No. 6,528,070, the teachings of which are incorporated herein by reference.

Additional examples of suitable anionic surfactants are described in U.S. Pat. Nos. 3,929,678, 5,929,022, 6,399,553, 6,489,285, 6,511,953, 6,949,498, and U.S. Pat. Appl. Publ. No. 2010/0184855, the teachings of which are incorporated herein by reference.

Cationic Surfactants

Suitable cationic surfactants include fatty amine salts (including diamine or polyamine salts), quaternary ammonium salts, salts of fatty amine ethoxylates, quaternized fatty amine ethoxylates, and the like, and mixtures thereof. Useful cationic surfactants are disclosed in *McCutcheon's Detergents & Emulsifiers* (M.C. Publishing, N. American Ed., 1993); Schwartz et al., *Surface Active Agents, Their Chemistry and Technology* (New York: Interscience, 1949) and in U.S. Pat. Nos. 3,155,591; 3,929,678; 3,959,461; 4,275,055; and 4,387,090. Suitable anions include halogen, sulfate, methosulfate, ethosulfate, tosylate, acetate, phosphate, nitrate, sulfonate, carboxylate, and the like.

Suitable quaternary ammonium salts include mono-long chain alkyl-tri-short chain alkyl ammonium halides, wherein the long chain alkyl group has from about 8 to about 22 carbon atoms and is derived from long-chain fatty acids, and wherein the short chain alkyl groups can be the same or different but preferably are independently methyl or ethyl. Specific examples include cetyl trimethyl ammonium chloride and lauryl trimethyl ammonium chloride. Preferred cationic surfactants include octyltrimethyl ammonium chloride, decyltrimethyl ammonium chloride, dodecyltrimethyl ammonium bromide, dodecyltrimethyl ammonium chloride, and the like. Cetrimonium chloride (hexadecyltrimethylammonium chloride) supplied as Ammonyx® Cetac 30, product of Stepan Company) is a preferred example.

Salts of primary, secondary and tertiary fatty amines are also suitable cationic surfactants. The alkyl groups of such amine salts preferably have from about 12 to about 22 carbon atoms, and may be substituted or unsubstituted. Secondary and tertiary amine salts are preferred, and tertiary amine salts are particularly preferred. Suitable amine salts include the halogen, acetate, phosphate, nitrate, citrate, lactate and alkyl sulfate salts. Salts of, for example, stearamidopropyl dimethyl amine, diethylaminoethyl stearamide, dimethyl stearamine, dimethyl soyamine, soyamine, myristyl amine, tridecylamine, ethyl stearylamine, N-tallowpropane diamine, ethoxylated stearylamine, stearylamine hydrogen chloride, soyamine chloride, stearylamine formate, N-tallowpropane diamine dichloride stearamidopropyl dimethylamine citrate, and the like are useful herein.

Suitable cationic surfactants include imidazolines, imidazoliniums, and pyridiniums, and the like, such as, for example, 2-heptadecyl-4,5-dihydro-1H-imidazol-1-ethanol, 4,5-dihydro-1-(2-hydroxyethyl)-2-isoheptadecyl-1phenyl methylimidazolium chloride, and 1-[2-oxo-2-[[2-[(1-oxoctadecyl)oxy]ethyl]-amino]ethyl]pyridinium chloride. For more examples, see U.S. Pat. No. 6,528,070, the teachings of which are incorporated herein by reference. Other suitable cationic surfactants include quaternized esteramines or "ester quats," and as disclosed in U.S. Pat. No. 5,939,059, the teachings of which are incorporated herein by reference. The cationic surfactant may be a DMAPA or other amido-amine-based quaternary ammonium material, including diamidoamine quats. It may also be a di- or poly-quaternary compound (e.g., a diester quat or a diamidoamine quat). Anti-microbial compounds, such as alkyldimethylbenzyl ammonium halides or their mixtures with other quaternary compounds, are also suitable cationic surfactants. An example is a mixture of an alkyl dimethylbenzyl ammonium chloride and an alkyl dimethyl ethylbenzylammonium chloride, available commercially from Stepan Company as BTC® 2125M.

Many suitable cationic surfactants are commercially available from Stepan Company and are sold under the Ammonyx®, Accosoft®, Amphosol®, BTC®, Stepanquat®, and Stepantex® trademarks. For further examples of suitable cationic surfactants, see U.S. Pat. No. 6,528,070, the teachings of which are incorporated herein by reference.

Nonionic or Amphoteric Surfactants

Nonionic surfactants typically function as wetting agents, hydrotropes, and/or couplers. Nonionic surfactants have no charged moieties. Suitable nonionic surfactants include, for example, fatty alcohols, alcohol fatty esters, fatty alcohol ethoxylates, alkylphenol ethoxylates, alkoxylate block copolymers, alkoxylated fatty amides, fatty amides, castor oil alkoxylates, polyol esters, fatty methyl esters, glycerol esters, glycol fatty esters, alkylpolyglucosides, methyl ester ethoxylates, tallow amine ethoxylates, polyethylene glycol esters, and the like. Fatty alcohol ethoxylates are preferred.

Amphoteric (or zwitterionic) surfactants have both cationic and anionic groups in the same molecule, typically over a wide pH range. Suitable amphoteric surfactants include, for example, amine oxides, betaines, amphoacetates, amphopropionates, alkyl glycinates, sulfobetaines, and the like. Specific examples include cocoamido-propylamine oxide, cetamine oxide, lauramine oxide, myristylamine oxide, stearamine oxide, alkyl betaines, cocobetaines, and amidopropyl betaines, (e.g., lauryl betaines, cocoamidopropyl betaines, lauramidopropyl betaines), and combinations thereof.

Other suitable nonionic and amphoteric surfactants are disclosed in U.S. Pat. Nos. 5,814,590, 6,281,178, 6,284,723, 6,605,584, and 6,511,953, the teachings of which related to those surfactants are incorporated herein by reference.

Organic Solvents

An organic solvent, preferably a water-soluble one, is optionally included in the hard surface cleaners. Preferred solvents include alcohols, glycols, glycol ethers, glycol ether esters, amides, esters, and the like. Examples include $C_1$-$C_6$ alcohols, $C_1$-$C_6$ diols, $C_3$-$C_{24}$ glycol ethers, and mixtures thereof. Suitable alcohols include, for example, methanol, ethanol, 1-propanol, isopropanol, 1-butanol, 1-pentanol, 1-hexanol, amyl alcohol, and mixtures thereof. Suitable glycols include, e.g., propylene glycol and 1,3-propanediol. Suitable glycol ethers include, e.g., ethylene glycol n-butyl ether, ethylene glycol n-propyl ether, ethylene glycol monohexyl ether, ethylene glycol phenyl ether, propylene glycol methyl ether, propylene glycol n-propyl ether, propylene glycol tert-butyl ether, propylene glycol n-butyl ether, diethylene glycol n-butyl ether, dipropylene glycol methyl ether, dipropylene glycol n-butyl ether, and the like, and mixtures thereof. Suitable glycol ether esters include, e.g., propylene glycol methyl ether acetate, propylene glycol n-butyl ether acetate, and the like.

When included, organic solvents are typically used in an amount within the range of 0.2 to 25 wt. %, preferably 0.5 to 10 wt. %, and more preferably 3 to 8 wt. %.

Other organic solvents suitable for use in hard surface cleaners are well known in the art and have been described for example, in U.S. Pat. Nos. 5,814,590, 6,284,723, 6,399,553, and 6,605,584, and in U.S. Pat. Appl. Publ. No. 2010/0184855, the teachings of which are incorporated herein by reference.

Other Components

The hard surface cleaner can include additional conventional components. Commonly, the cleaners include one or more additives such as builders, buffers, abrasives, electrolytes, bleaching agents, fragrances, dyes, foaming control agents, antimicrobial agents, thickeners, pigments, gloss enhancers, enzymes, detergents, surfactants, cosolvents, dispersants, polymers, silicones, hydrotropes, and the like.

In one aspect, the hard surface cleaner includes an alkali metal citrate, preferably sodium citrate or potassium citrate. Use of citrates is known to enhance the cleaning performance of certain hard surface cleaners (see, e.g., U.S. Pat. Appl. Publ. No. 2011/0036372, the teachings of which are incorporated herein by reference). Interestingly, this reference illustrates hard surface cleaning formulations made at either acidic or basic pH values, i.e., pH 4 or pH 10, but not at neutral pH.

In another aspect, the invention relates to an aqueous hard surface cleaner which comprises a monounsaturated fatty N,N-dialkylamide, and which by measure of ASTM D4488-95 A5 soil, provides superior percent cleaning at a pH less than 10 than it does at pH 10 and higher. Suitable monounsaturated fatty N,N-dialkylamides have already been described. Preferably, the cleaners comprise a $C_8$-$C_{14}$ fatty N,N-dialkylamide. In a preferred aspect, the cleaner provides superior percent cleaning at a pH within the range of 6.0 to 9.0 than it does at pH 10 and higher. Preferred hard surface cleaners comprise from 75 to 99.5 wt. % of water, from 0.1 to 5 wt. % of a monounsaturated $C_8$-$C_{14}$ fatty N,N-dialkylamide, and from 0.1 to 5 wt. % of one or more surfactants selected from the group consisting of anionic, cationic, nonionic, and amphoteric surfactants.

In yet another aspect, the invention relates to aqueous hard surface cleaners that are suitable for use in removing baked-on soil. These cleaners are used to remove tough soils from ovens, grills, and the like. In prior art compositions intended for this use, alkali metal hydroxides are a principal ingredient, and the formulations are consequently highly alkaline. In contrast, the inventive cleaners are relatively neutral; they have a pH within the range of 7.0 to 9.0, preferably 7.2 to 9.0, more preferably 7.5 to 8.8, even more preferably 8.0 to 8.5. The inventive cleaners comprise from 50 to 99 wt. % of water; from 0.5 to 15 wt. % of a monounsaturated $C_8$-$C_{14}$ fatty N,N-dialkylamide; and from 0.5 to 15 wt. % of a surfactant. The surfactant is selected from the group consisting of anionic, cationic, nonionic, and amphoteric surfactants. More preferred cleaners comprise from 75 to 95 wt. % of water; from 1 to 10 wt. % of the monounsaturated $C_8$-$C_{14}$ fatty N,N-dialkylamide, and from 1 to 10 wt. % of the surfactant.

As shown in Tables 5 and 6 below, we surprisingly found that cleaners can be formulated at relatively neutral pH (7.0 to 9.0) while retaining the ability to remove even baked-on soil when a monounsaturated fatty N,N-dialkylamide is included in the formulation. Suitable fatty N,N-dialkylamides and surfactants for these cleaners have already been described.

Concentrates

In another aspect, the invention relates to a dilutable hard surface cleaner concentrate. The concentrate comprises 1 to 50 wt. % of a monounsaturated N,N-dialkylamide and 1 to 50 wt. % of one or more surfactants selected from anionic, cationic, nonionic, and amphoteric surfactants. Suitable monounsaturated N,N-dialkylamides and surfactants have already been described. Preferably, the concentrates further comprise a minimum amount of water needed to solubilize the other components. Preferably, the amount of water used is within the range of 1 to 20 wt. %, more preferably from 1 to 10 wt. %. The formulator or even the ultimate customer may dilute the concentrate with water for normal use.

The following examples merely illustrate the invention. Those skilled in the art will recognize many variations that are within the spirit of the invention and scope of the claims.

EXAMPLES

Hard-Surface Cleaners: Aqueous Degreasers

This test measures the ability of a cleaning product to remove a greasy dirt soil from a white vinyl tile. The test is automated and uses an industry standard Gardner Straight Line Washability Apparatus. A camera and controlled lighting are used to take a live video of the cleaning process. The machine uses a sponge wetted with a known amount of test product. As the machine wipes the sponge across the soiled tile, the video records the result, from which a cleaning percentage can be determined. A total of 6 strokes are made using an undiluted test formulation, and cleaning is calculated for each of strokes 1-6 to provide a profile of the cleaning efficiency of the product.

Test Samples:

All-purpose cleaners are prepared from Bio-Soft® N91-6 nonionic surfactant (0.4 g, product of Stepan Company), Bio-Soft® D-40 (1.0 g, 40% actives) anionic surfactant, fatty amide (0.5 g, 100% actives), citrate or carbonate (0.2 g when present), 5% aq. HCl or 5% aq. NaOH to adjust pH where indicated, and water (q.s. to 100 g). In the inventive examples, the fatty amide is C10-25, a monounsaturated fatty amide prepared as described in WO 2012/061094 (see p. 25). In the comparative examples, the fatty amide is either Steposol® M-8-10, a mixture of N,N-dimethylcaprylamide and N,N-dimethylcapramide, or Steposol® M-10, which is N,N-dimethylcapramide (the C10 amide), both products of Stepan. The samples are used "as is" for the Gardner test.

Soil Composition (from Gardner ASTM D4488-95 Method):

Tiles are soiled with a particulate medium (50 mg) and an oil medium (5 drops). The particulate medium is composed of (in parts by weight) hyperhumus (39), paraffin oil (1), used motor oil (1.5), Portland cement (17.7), silica (18), molacca black (1.5), iron oxide (0.3), bandy black clay (18), stearic acid (2), and oleic acid (2). The oil medium is composed of kerosene (12), Stoddard solvent (12), paraffin oil (1), SAE-10 motor oil (1), Crisco® shortening, product of J.M. Smucker Co. (1), olive oil (3), linoleic acid (3), and squalene (3).

TABLE 1

Performance of Aqueous Hard Surface Cleaners with Fatty Amides: Comparison with Steposol ® M-8-10

| | Example[1] | | | | | | | |
|---|---|---|---|---|---|---|---|---|
| | 1 | 2 | C3 | C4 | C5 | C6 | C7 | C8 |
| C10-25 unsaturated amide | Y | Y | N | N | Y | Y | N | N |
| Steposol ® M-8-10 | N | N | Y | Y | N | N | Y | Y |
| Na citrate added | Y | N | Y | N | N | N | N | N |
| Na carbonate added | N | N | N | N | Y | N | Y | N |
| adjust to citrate pH with HCl | N | Y | N | Y | N | N | N | N |
| adjust to carbonate pH with NaOH | N | N | N | N | N | Y | N | Y |
| pH | ~8 | ~8 | ~8 | ~8 | ~10 | ~10 | ~10 | ~10 |
| Gardner results,[2] % clean | | | | | | | | |
| Stroke 1 | 88.8 | 86.8 | 83.1 | 83.0 | 83.9 | 85.0 | 84.3 | 84.6 |
| Stroke 2 | 93.0 | 91.0 | 88.4 | 87.8 | 89.5 | 88.4 | 87.7 | 88.2 |
| Stroke 4 | 93.5 | 92.0 | 90.2 | 89.4 | 92.2 | 90.5 | 89.7 | 90.4 |
| Stroke 6 | 95.6 | 94.0 | 91.4 | 89.3 | 92.2 | 90.6 | 91.2 | 90.5 |

[1]Formulations include Bio-soft ® N91-6 (0.4 g, 100% actives), Bio-soft ® D-40 (1.0 g, 40% actives), fatty amide (0.5 g, 100% actives), citrate or carbonate (0.2 g when present), 5% aq. HCl or 5% aq. NaOH to adjust pH, and water (q.s. to 100 g).
[2]Gardner straightline washability test

TABLE 2

Performance of Aqueous Hard Surface Cleaners with Fatty Amides: Comparison with Steposol ® M-10

| | Example[1] | | | | | | | |
|---|---|---|---|---|---|---|---|---|
| | 1 | 2 | C9 | C10 | C5 | C6 | C11 | C12 |
| C10-25 unsaturated amide | Y | Y | N | N | Y | Y | N | N |
| Steposol ® M-10 | N | N | Y | Y | N | N | Y | Y |
| Na citrate added | Y | N | Y | N | N | N | N | N |
| Na carbonate added | N | N | N | N | Y | N | Y | N |
| adjust to citrate pH with HCl | N | Y | N | Y | N | N | N | N |
| adjust to carbonate pH with NaOH | N | N | N | N | N | Y | N | Y |
| pH | ~8 | ~8 | ~8 | ~8 | ~10 | ~10 | ~10 | ~10 |
| Gardner results,[2] % clean | | | | | | | | |
| Stroke 1 | 88.8 | 86.8 | 82.5 | 81.5 | 83.9 | 85.0 | 80.3 | 78.3 |
| Stroke 2 | 93.0 | 91.0 | 87.7 | 85.9 | 89.5 | 88.4 | 83.8 | 88.0 |
| Stroke 4 | 93.5 | 92.0 | 90.8 | 88.4 | 92.2 | 90.5 | 86.5 | 89.3 |
| Stroke 6 | 95.6 | 94.0 | 92.3 | 89.8 | 92.2 | 90.6 | 89.0 | 91.0 |

[1]Formulations include Bio-soft ® N91-6 (0.4 g, 100% actives), Bio-soft ® D-40 (1.0 g, 40% actives), fatty amide (0.5 g, 100% actives), citrate or carbonate (0.2 g when present), 5% aq. HCl or 5% aq. NaOH to adjust pH, and water (q.s. to 100 g).
[2]Gardner straightline washability test

TABLE 3

Performance of Aqueous Hard Surface Cleaners with Fatty Amides: Effect of pH

| | Example[1] | | | | |
|---|---|---|---|---|---|
| | C13 | 14 | 15 | C16 | C17 |
| C10-25 unsaturated amide | Y | Y | Y | Y | Y |
| Na citrate added | Y | Y | Y | Y | Y |
| Na carbonate added | N | N | N | N | Y |
| adjust to target pH with 5% HCl | Y | Y | N | N | N |
| adjust to target pH with 5% NaOH | N | Y | Y | Y | Y |
| target pH | 5.0 | 7.0 | 8.0 | 10.0 | 10.0 |
| Gardner results,[2] % clean | | | | | |
| Stroke 1 | 78.7 | 81.9 | 84.7 | 82.1 | 78.2 |
| Stroke 2 | 85.5 | 87.6 | 87.9 | 87.2 | 84.7 |
| Stroke 4 | 90.5 | 90.6 | 90.4 | 91.2 | 87.3 |
| Stroke 6 | 92.1 | 91.8 | 91.9 | 90.8 | 88.8 |

[1]Formulations include Bio-soft ® N91-6 (0.4 g, 100% actives), Bio-soft ® D-40 (1.0 g, 40% actives), fatty amide (0.5 g, 100% actives), citrate and/or carbonate (0.2 g when present), 5% aq. HCl or 5% aq. NaOH to adjust pH, and water (q.s. to 100 g).
[2]Gardner straightline washability test

TABLE 4

Performance of Aqueous Hard Surface Cleaners: Unsaturated Fatty Amide versus Other Solvents

| | Example[1] | | | | | |
|---|---|---|---|---|---|---|
| | 18 | 19 | C20 | C21 | C22 | C23 |
| Solvent | C10-25 | C10-25 | M8-10 | DPnB | BzOH | d-Limonene |
| Solvent amount (wt. %) | 0.5 | 0.25 | 0.5 | 0.5 | 0.5 | 0.5 |
| Na citrate added | Y | Y | Y | Y | Y | Y |
| pH | ~8 | ~8 | ~8 | ~8 | ~8 | ~8 |
| Gardner results,[2] % clean | | | | | | |
| Stroke 1 | 89.6 | 81.3 | 82.2 | 78.0 | 79.8 | 82.0 |
| Stroke 2 | 91.3 | 86.3 | 84.6 | 82.4 | 83.3 | 87.8 |

[1]Formulations include Bio-soft N91-6 (0.4 g, 100% actives), Bio-soft D-40 (1.0 g, 40% actives), solvent (0.5 or 0.25 g, 100% actives), citrate (0.2 g), and water (q.s. to 100 g).
[2]Gardner straightline washability test
DPnB = dipropylene glycol n-butyl ether;
BzOH = benzyl alcohol As the results in Table 1 demonstrate, the best cleaning performance is observed in Examples 1 and 2, which include a monounsaturated fatty amide and are formulated to about pH 8. Comparative Examples 3 and 4 show that cleaning is not as rapid (see first two strokes) and overall performance is not as effective with Steposol® M-8-10, a commercially available mixture of saturated C8 and C10 fatty amides (N,N-dimethylcaprylamide/N,N-dimethylcapramide mixture) when tested at about pH 8. Under more alkaline conditions (pH ~10), none of the formulations (Comparative Examples 5-8) performs as well as the unsaturated fatty amide at pH 8. Although alkaline conditions are generally believed necessary for obtaining good performance with hard surface cleaners, we surprisingly found that the unsaturated fatty amides perform as well or better at more neutral pH (within the range of 6-9). The result is valuable because neutral formulations are considered to be less corrosive, less toxic, and generally less hazardous to end users.

Table 2 compares the unsaturated C10 fatty amide (C10-25) with the Steposol® M-10, its saturated analog. This comparison eliminates possible performance differences attributable to the C8 component of Steposol® M-8-10. At about pH 8, the unsaturated fatty amide is the clear winner (see Examples 1 and 2 versus Comparative Examples 9 and 10). Again, when more alkaline conditions are used (pH ~10), none of the formulations, including the Steposol® M-10 formulations (Comparative Examples 11 and 12), performs as well as the unsaturated fatty amide at pH 8.

At Table 3 illustrates, when only the unsaturated fatty amide is considered and dilute acid or base is added to target a particular pH, the formulations at neutral pH (within the range of 6.0 to 9.0, see Examples 14 and 15) perform better than the one at pH 5 (Comparative Example 13) and as well as or better than the formulations at pH 10 (Comparative Examples 16 and 17). As noted above, the ability to formulate an effective hard surface cleaner at neutral pH is considered unusual but valuable.

Table 4 compares the performance of various solvent alternatives to the unsaturated fatty amide in a citrate pH formulation (pH ~8). The monounsaturated fatty amide (C10-25) outperforms common solvents used in hard surface cleaners (e.g., dipropylene glycol n-butyl ether, d-limonene, and benzyl alcohol) when tested at the same solvent level at the relatively neutral pH. See Example 18 versus Comparative Examples C21-C23). Moreover, when the concentration of C10-25 is cut in half (Example 19), the cleaner is still as effective as the traditional favorites.

Performance on Baked-on Soil

Baked-on soils pose an even greater challenge for formulating cleaners at relatively neutral pH. In fact, because baked-on soil responds well to alkalinity, most oven cleaners contain an alkali metal hydroxide as a primary ingredient. The experiments below are designed to test the ability of relatively neutral pH formulations to remove baked-on soils.

Soil Application:

Aged cooking oil soil is prepared using polymerized soybean oil (90%) combined with Gardner particulate (10%), then diluted with isopropyl alcohol to 10% strength. White baked enamel tiles are coated with soil and then baked. Tiles are pre-treated by applying 1 g of soil, smearing it over the tile, then wiping off with a paper towel. Soil solution (2.25 g) is applied to the tile and allowed to spread evenly while the alcohol evaporates. Tiles are placed in an oven at 250° F. (121° C.) for 1 h to bake the soil to full firmness, which simulates oven-based grease soil. Tiles are removed from the oven and allowed to cool for 1 h. The resulting soil cannot be removed with strong pressure or rubbing with fingers.

Solvents tested include unsaturated N,N-dialkylamide C10-25, Steposol® M-10, and Dowanol® DPnB (dipropylene glycol n-butyl ether).

Test Method (pH 11 and 13):

A drop of each test sample is applied every 15 seconds to a soiled tile for each pH until six drops of each sample have been applied. Fifteen seconds after applying the sixth drop, the tile is rinsed with cold water for 20 seconds and allowed to dry.

Tiles are graded quantitatively by spot count. If all of the drops remove the soil, including the sixth drop, the count is 6. If only the first drop, which is in contact with the soiled tile for 90 seconds, removes the soil, the count is 1. For no removal of soil, the count is 0.

Test Method (pH 7 and 9):

The method described above for pH 11 and 13 proves inadequate for evaluating samples at pH 6, 7, and 9. The method is modified by applying five drops and using 30 second intervals. (For pH 6, no soil removal is observed using either a 15 or 30 second interval.)

Formulations

Bio-Soft® N91-6 nonionic surfactant (2.0 wt. % active), Bio-Soft® D-40 anionic surfactant (2.0 wt. % active), sodium citrate (1.0 wt. %), and test solvent (2.5 wt. %).

TABLE 5

Results using Baked-On Soil

| Solvent | pH | Drop interval, s | Comment | Count |
|---|---|---|---|---|
| C10-25 | 5.8 | 30 | faint impression; no removal | 0 |
| | 7.3 | 30 | full removal to surface on 1st spot | 3 |
| | 8.7 | 30 | full removal to surface on 1st spot | 4 |
| | 10.5 | 15 | full removal to surface on 1st spot | 2 |
| | 12.5 | 15 | full removal to surface on 1st spot | 4 |
| Steposol ® M-10 | 5.8 | 30 | no effect | 0 |
| | 7.3 | 30 | partial removal on all spots | 2 |
| | 8.7 | 30 | partial removal on all spots | 3 |
| | 10.5 | 15 | partial removal on all spots | 0 |
| | 12.5 | 15 | partial removal on all spots | 1 |
| dipropylene glycol n-butyl ether (DPnB) | 5.8 | 30 | nothing | 0 |
| | 7.3 | 30 | partial removal on all spots | 3 |
| | 8.7 | 30 | partial removal on all spots | 4 |
| | 10.5 | 15 | partial removal on all spots | 3 |
| | 12.5 | 15 | partial removal on all spots | 4 |

As the results in Table 5 indicate, none of the solvents tested is effective at pH 6 (5.8), and all are at least somewhat effective at pH 11 (10.5) or 13 (12.5). Interestingly, however, the performance of unsaturated fatty N,N-dialkylamide C10-25 is acceptable even at pH 7 or 9. This contrasts with the performance of either the saturated analog (Steposol® M-10) or dipropylene glycol n-butyl ether.

Image analysis software normally used to quantify Gardner straightline washability data (see, e.g., the earlier examples herein and PCT Int. Appl. No. WO 2012/061103) is used to analyze the photographs from the pH 7 and pH 9 testing and to compute a % clean value. Results appear in Table 6, below:

TABLE 6

% Clean v. Time for Baked Cooking Oil

| time, s | C10-25 | Steposol ® M-10 | DPnB |
|---|---|---|---|
| % Clean at pH 7 (7.3) | | | |
| 30 | 52.9 | 1.1 | 27.8 |
| 60 | 62.4 | −7.2 | 27.2 |
| 90 | 66.5 | 3.0 | 28.3 |
| 120 | 72.0 | 47.9 | 32.4 |
| 150 | 81.5 | 59.6 | 29.1 |
| % Clean at pH 9 (8.7) | | | |
| 30 | 72.8 | 37.4 | 55.7 |
| 60 | 79.3 | 43.3 | 73.6 |
| 90 | 85.5 | 56.8 | 76.8 |
| 120 | 100 | 56.9 | 77.4 |
| 150 | 97.0 | 50.0 | 72.1 |

The results in Table 6 demonstrate a clear advantage of using the unsaturated N,N-dialkylamide at relatively neutral pH even on tough, baked-on soils.

The preceding examples are meant only as illustrations. The following claims define the invention.

We claim:

1. An aqueous hard surface cleaner consisting of:

(a) from 75 to 99.5 wt. % of water;

(b) from 0.1 to 5 wt. % of a monounsaturated $C_{10}$ fatty N,N-dialkylamide having the structure:

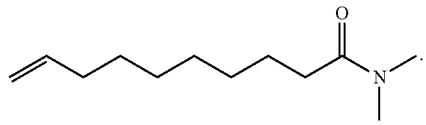

and (c) from 0.1 to 5 wt. % of one or more surfactants selected from the group consisting of anionic and nonionic surfactants;

wherein the anionic surfactant is selected from the group consisting of alkyl sulfates, alkyl ether sulfates, olefin sulfonates, α-sulfonated alkyl esters, α-sulfonated alkyl carboxylates, alkyl aryl sulfonates, sulfoacetates, sulfosuccinates, alkane sulfonates, alkyl ether/ethoxy carboxylates, alkylphenol alkoxylate sulfates, and mixtures thereof; and wherein the nonionic surfactant is selected from the group consisting of fatty alcohols, alcohol fatty esters, fatty alcohol ethoxylates, alkylphenol ethoxylates, alkoxylate block copolymers, alkoxylated fatty amides, fatty amides, castor oil alkoxylates, polyol esters, fatty methyl esters, glycerol esters, glycol fatty esters, alkylpolyglucosides, methyl ester ethoxylates, tallow amine ethoxylates, polyethylene glycol esters, and mixtures thereof;

(d) optionally, an acid or a base in an amount effective to adjust pH;

(e) optionally, 0.2 to 25 wt. % of a water-soluble organic solvent selected from the group consisting of $C_1$-$C_6$ alcohols, $C_2$-$C_6$ diols, $C_3$-$C_{24}$ glycol ethers, and mixtures thereof;

(f) optionally, a citrate or carbonate;

(g) optionally, one or more additives selected from the group consisting of builders, abrasives, electrolytes, bleaching agents, dyes, foaming control agents, antimicrobial agents, thickeners, pigments, gloss enhancers, enzymes, silicones, and hydrotropes;

wherein the cleaner has a pH within the range of 7.0 to 9.0.

2. The cleaner of claim 1 having a pH within the range of 7.0 to 8.0.

3. The cleaner of claim 1 wherein the anionic surfactant is an alkyl aryl sulfonate.

4. The cleaner of claim 1 wherein the nonionic surfactant is a fatty alcohol ethoxylate.

5. A dilutable hard surface cleaner concentrate consisting of:

(a) 1 to 50 wt. % of a monounsaturated $C_{10}$ fatty N,N-dialkylamide having the structure:

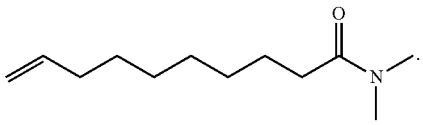

and (b) 1 to 50 wt. % of one or more surfactants selected from the group consisting of anionic and nonionic surfactants;

wherein the anionic surfactant is selected from the group consisting of alkyl sulfates, alkyl ether sulfates, olefin sulfonates, α-sulfonated alkyl esters, α-sulfonated alkyl carboxylates, alkyl aryl sulfonates, sulfoacetates, sulfosuccinates, alkane sulfonates, alkyl ether/ethoxy carboxylates, alkylphenol alkoxylate sulfates, and mixtures thereof; and wherein the nonionic surfactant is selected from the group consisting of fatty alcohols, alcohol fatty esters, fatty alcohol ethoxylates, alkylphenol ethoxylates, alkoxylate block copolymers, alkoxylated fatty amides, fatty amides, castor oil alkoxylates, polyol esters, fatty methyl esters, glycerol esters, glycol fatty esters, alkylpolyglucosides, methyl ester ethoxylates, tallow amine ethoxylates, polyethylene glycol esters, and mixtures thereof;

(d) optionally, an acid or a base in an amount effective to adjust pH;

(e) optionally, 0.2 to 25 wt. % of a water-soluble organic solvent selected from the group consisting of $C_1$-$C_6$ alcohols, $C_2$-$C_6$ diols, $C_3$-$C_{24}$ glycol ethers, and mixtures thereof;

(f) optionally, a citrate or carbonate;

(g) optionally, one or more additives selected from the group consisting of builders, abrasives, electrolytes, bleaching agents, dyes, foaming control agents, antimicrobial agents, thickeners, pigments, gloss enhancers, enzymes, silicones, and hydrotropes;

wherein the concentrate, upon dilution with water, gives an aqueous cleaner having a pH within the range of 7.0 to 9.0.

6. The concentrate of claim 5 that gives, upon dilution with water, a pH within the range of 7.0 to 8.0.

7. The concentrate of claim 5 wherein the anionic surfactant is an alkyl aryl sulfonate.

8. The concentrate of claim 5 wherein the nonionic surfactant is a fatty alcohol ethoxylate.

9. An aqueous hard surface cleaner suitable for use on baked-on soil, consisting of:

(a) from 50 to 99 wt. % of water;

(b) from 0.5 to 15 wt. % of a monounsaturated $C_{10}$ fatty N,N-dialkylamide having the structure:

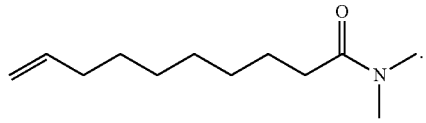

and (c) from 0.5 to 15 wt. % of a mixture of an anionic surfactant and a nonionic surfactant, wherein the anionic surfactant is an alkyl aryl sulfonate and the nonionic surfactant is a fatty alcohol ethoxylate;

(d) optionally, an acid or a base in an amount effective to adjust pH;

(e) optionally, 0.2 to 25 wt. % of a water-soluble organic solvent selected from the group consisting of $C_1$-$C_6$ alcohols, $C_2$-$C_6$ diols, $C_3$-$C_{24}$ glycol ethers, and mixtures thereof;

(f) optionally, a citrate or carbonate;

(g) optionally, one or more additives selected from the group consisting of builders, abrasives, electrolytes, bleaching agents, dyes, foaming control agents, antimicrobial agents, thickeners, pigments, gloss enhancers, enzymes, silicones, and hydrotropes;

wherein the cleaner has a pH within the range of 7.0 to 9.0.

10. The cleaner of claim 9 consisting of 75 to 95 wt. % of water, 1 to 10 wt. % of the monounsaturated $C_{10}$ fatty N,N-dialkylamide, and 1 to 10 wt. % of the surfactant mixture.

* * * * *